US005577401A

United States Patent [19]

Pernick

[11] Patent Number: 5,577,401

[45] Date of Patent: Nov. 26, 1996

[54] KNITTING MACHINE CYLINDER HAVING A HARDENED TOP INSERT RING AND METHOD OF MAKING SAME

[75] Inventor: David Pernick, Kings Point, N.Y.

[73] Assignee: Monarch Knitting Machinery Corp., Glendale, N.Y.

[21] Appl. No.: 558,803

[22] Filed: Nov. 15, 1995

[51] Int. Cl.[6] ..... D04B 9/00; B23P 19/02

[52] U.S. Cl. ..... 66/8; 66/114; 29/525

[58] Field of Search ..... 66/8, 114, 115; 29/525; 84/276, 42

[56] References Cited

U.S. PATENT DOCUMENTS

| | | | |
|---|---|---|---|
| 1,848,293 | 3/1932 | Howie | 66/114 |
| 1,952,928 | 3/1934 | Lawson . | |
| 2,120,796 | 6/1938 | Coile . | |
| 2,596,535 | 5/1952 | Curtis . | |
| 2,845,918 | 8/1958 | Goodzeit | 384/276 X |
| 2,951,355 | 9/1960 | Bryant . | |
| 3,230,742 | 1/1966 | Roedel | 66/8 |
| 3,817,058 | 6/1974 | Lombardi . | |
| 4,241,483 | 12/1980 | Voitas | 384/276 X |
| 4,926,529 | 5/1990 | Hosmer et al. | 384/42 X |
| 5,077,990 | 1/1992 | Plath . | |
| 5,102,239 | 4/1992 | Momose et al. | 384/276 |
| 5,145,265 | 9/1992 | Flem | 384/276 X |
| 5,398,526 | 3/1995 | Liu . | |
| 5,442,936 | 8/1995 | Berger et al. | 66/114 X |
| 5,445,003 | 8/1995 | Gottschalk et al. | 72/110 |

FOREIGN PATENT DOCUMENTS

| | | | |
|---|---|---|---|
| 500612 | 3/1920 | France | 66/114 |

*Primary Examiner*—John J. Calvert
*Attorney, Agent, or Firm*—Bell, Seltzer, Park & Gibson, P.A.

[57] ABSTRACT

A durable cylinder assembly for a circular knitting machine is described. The cylinder assembly includes a cylinder body having an outer cylindrical face and an upper face including a plurality of spaced-apart substantially radial channels. A shaped circumferential indentation circumscribes an upper end of the outer cylindrical face, and a hardened circular band is matingly engaged with the indentation to define a durable bearing surface for reciprocating elements the knitting machine, e.g. the sinkers and/or needles. The hardened band is preferably formed of heat treated metal and has a discontinuous circumference defined by a single cut, which is preferably single or double biased. The indentation provided in the cylinder body is desirably in the form a right angle, and the band preferably has a rectangular cross-sectional configuration so as to mate securely with the indentation. A method of improving the durability of a knitting machine cylinder by applying such a hardened circular band to the cylinder is also described.

35 Claims, 2 Drawing Sheets

KNITTING MACHINE CYLINDER HAVING A HARDENED TOP INSERT RING AND METHOD OF MAKING SAME

FIELD OF THE INVENTION

The invention relates generally to a durable, wear-resistant cylinder for a circular knitting machine, and more specifically to a cylinder assembly using a hardened circular band which matingly engages an upper portion of a knitting machine cylinder to define wear surfaces for reciprocating elements of the knitting machine.

BACKGROUND OF THE INVENTION

Conventional knitting machine cylinders generally include four main parts: a cylinder body, a sinker ring or dial, a top ring, and a plurality of metal inserts. The outer cylindrical face of the cylinder body is typically machined to form spaced-apart, radial slots in which metal inserts are individually positioned. The metal inserts extend outwardly beyond the slots to define tricks between adjacent inserts. These tricks receive the needles of the knitting machine, and act as guides for the vertical reciprocating needle motion.

The top ring is conventionally formed as a separate element which is secured to the top of the cylinder. Prior to securement to the cylinder, the top ring is typically machined to define a plurality of radial slots for receiving the sinkers. This machining process must be very precise, in order that the slots in the top ring will line up correctly with the slots in the cylinder. Thus, machining of the top ring can be time consuming and expensive.

When the top ring is secured to the top of the knitting machine cylinder, it provides support for lower surfaces of the sinkers, i.e. the bottoms of the sinker pawl, and for the backs of the needles. Because the reciprocating motions of the sinkers and needles generate large amounts of frictional forces along the wear surfaces of the top ring, it can become worn after only a minimal amount of use. Further, the tensional forces exerted by the knitted fabric being drawn down from the machine tend to localize the forces along the top ring, thereby exacerbating the problem of top ring wear.

To counter the effects of these frictional forces and minimize the resultant wear of the top ring, top rings have historically been heat treated in order to harden them so that they will be more resistant to wear. Heat treatment, however, often results in deformation of the top ring due to expansion, contraction and/or warping. As discussed above, the top ring must be precisely shaped in order that it cooperates properly with the cylinder body; thus, deformations resulting from the heat treatment of the top ring must be corrected prior to its use. Correction of such top ring defects is typically expensive and time consuming, and thus can represent a significant cost of knitting machine production and operation. Further, because these prior arrangements require machining and slotting of two individual parts, i.e. the cylinder body and top ring, manufacture of the machines tends to be relatively slow and expensive. FIGS. 1–3 depict such a typical prior art cylinder assembly for a circular knitting machine, shown generally at 10. The cylinder includes a cylinder body 12, which has a plurality of spaced-apart radially extending walls 14, between which are defined a plurality of slots 16. An insert 18 is positioned within each of the slots 16, with each of the inserts extending outwardly beyond the walls 14 to define needle-receiving channels (commonly referred to as tricks) 20 between adjacent inserts.

A top ring 22 is secured to an upper face of the cylinder body 12 such as by a screw 28 which extends through an opening 30 in the top ring and a threaded opening 32 in the cylinder body. The top ring 22 includes a plurality of upwardly extending walls 24 along its upper surface, with the walls being spaced apart to define sinker receiving channels 26. As discussed above, the top ring 22 typically provides bearing surfaces for reciprocating needles (not shown) positioned within the tricks 20 and for sinkers (not shown) which extend through the channels 26 on the top ring. Because large amounts of frictional forces tend to be produced by the reciprocating motions of the needles and sinkers, the bearing surfaces tend to wear adversely. Thus the top ring 22 is typically heat treated to harden it so that the ring is better able to withstand such frictional forces. As illustrated in FIGS. 1–3, however, the mating engagement of the top ring 22 to the cylinder body 12 must be tight and accurate in order that the moving elements of the knitting machine are properly aligned with the channels in which they reciprocate. Thus, any warping or other deformation which results from the heat treatment must be corrected before the cylinder can be effectively utilized. Also, the machined, heat treated top ring tends to be expensive to make and expensive to replace.

Other attempts have been made to overcome the deleterious effects of the frictional forces on the knitting machine cylinder. For example, U.S. Pat. No. 3,230,742 to Roedel describes a replaceable synthetic insert for increasing resistance of the inner sinker ring to frictional wear. A replaceable insert in the form of a ring is bonded by a layer of adhesive to the top of the inner sinker ring. The insert is then machined to provide guides for the sinkers and needles. Because the insert must be machined to define slots for the sinkers, the manufacturer must be particularly exact in slotting the insert in order that it will correspond appropriately to the slots containing the inserts in the outer cylindrical face of the cylinder body. Additionally, because the insert is a continuous circular band, there is no provision for any adjustment in its circumference.

U.S. Pat. No. 1,952,928 to Lawson describes a needle cylinder having a plurality of removable inserts rather than a continuous top ring. The upper edge of the needle cylinder contains grooves for frictional engagement with the inserts. The inserts are described as providing guidance for the horizontal motion of the sinkers and they may be connected by extensions to form sections of a sectional top ring. There is no provision, however, for making the individual inserts resistant to the frictional forces provided by the movement of the sinkers and needles.

U.S. Pat. No. 5,077,990 to Plath describes a friction reducing surface applied to a conventional slotted top ring of a circular knitting machine. Though this top ring is treated to reduce the amount of wear it receives, it requires the formation of slots therein. Thus, when the top ring is replaced, a new top ring must be accurately slotted to match the slots in the outer cylinder body face.

Thus, a need exists for a cylinder structure for a knitting machine which can withstand the deleterious effects of the frictional forces produced by the sinker and/or needle movements, and which can be readily and easily replaced, and which can be inexpensively fabricated.

Further, a need exists for a cylinder assembly for a circular knitting machine which can be hardened by conventional heat treatment processes and which can accommodate for slight deformations resulting from the hardening process, without requiring re-machining.

SUMMARY OF THE INVENTION

With the foregoing in mind, it is an object of the present invention to provide a cylinder assembly for a circular knitting machine which provides durable wear surfaces for the reciprocating elements of the knitting machine, and which can be readily and easily produced.

It is a further object of the invention to provide a heat treated wear surface for the reciprocating elements of a knitting machine which does not require re-machining as a result of slight deformations which may occur during the heat treating process.

An additional object of the present invention is to provide a method for increasing the lifespan of a knitting machine by providing the wear-prone areas of the knitting cylinder with a device which can withstand great amounts of frictional forces and which can be easily manufactured and applied to the machine.

It is a further object of the present invention to provide a durable wear surface for the reciprocating elements of a knitting machine which can easily and inexpensively fabricated, and readily replaced when it becomes worn, without the expenses or difficulties typically associated with replacement of the top ring or cylinder.

These and other objects are achieved by providing a cylinder assembly for a circular knitting machine which can withstand the frictional forces commonly associated with the reciprocating movements of the sinkers and/or needles. The cylinder assembly desirably has a cylinder body having an outer cylindrical face and an upper face, with the upper face including a plurality of spaced apart, substantially radial channels which are defined by a plurality of upwardly extending walls. The cylinder body also desirably has a plurality of spaced-apart outwardly extending walls on its outer cylindrical face, between which are defined a plurality of slots. Each slot is adapted to receive an insert which extends outwardly beyond the walls, such that adjacent inserts define needle-receiving channels or tricks therebetween.

A shaped indentation desirably circumscribes an upper end of the outer cylindrical face. A hardened circular band is matingly engaged with the circumferential indentation to define a durable bearing surface for reciprocating elements of the knitting machine, such as the sinkers and/or needles. In a preferred form of the invention, the shaped indentation is in the form of a right angle, and the hardened circular band has a substantially rectangular cross-sectional configuration. In this way, the hardened circular band can readily conform to the indentation in the upper end of the cylinder face.

The hardened circular band is preferably formed of metal, which is heat treated according to conventional processes in order to increase its hardness. Desirably, the band is treated to achieve a hardness of the high 50's or low 60's on the Rockwell C scale.

In a particularly preferred embodiment of the invention, the hardened circular band has a discontinuous circumference which is preferably defined by a single cut. In this way, the band can compensate for contraction, expansion, warping, or other deformation of the band material which may occur during the heat treating process. The single cut is preferably biased in more than one direction, to thereby extend in diagonal directions along adjacent faces of the band material. This configuration not only assists in the easy installation of the band on the cylinder body by enabling it to assume a friction fit by compression on the cylinder body, but it also enables the band to accommodate a slight amount of deformation during heat treatment, without resulting in a gap in the ring into which the reciprocating elements of the machine could tend to fall. Stated differently, because the cut is biased, it extends diagonally relative to the motion of the needles and sinkers, thereby ensuring that in the event the band is warped, each of the reciprocating elements will be supported by the band, rather than face a risk of becoming lodged in a gap which could be formed by the discontinuous circumference of the band.

Additionally, because the band does not require the machining of slots therein, its manufacture is much simpler and less expensive, and the band can be easily replaced when it becomes worn. Further, should a great amount of deformation occur during the heat treating process, the band can be more easily reshaped than a conventional slotted top portion. In addition, the positioning of the band on the knitting cylinder is much easier than with the top rings used in prior art methods, because there are no slots which need be positioned properly with respect to those in the cylinder body. Thus, the assembly of the present invention obviates the need for the machining and slotting of new top ring or cylinder body constructions following wear, and the delicate process of properly aligning such elements, thus eliminating these costly and time consuming processes. As a result, machine down time can be reduced by a great amount, and the expense typically associated with the frictional wear on the machine parts is greatly reduced.

BRIEF DESCRIPTION OF THE DRAWINGS

The foregoing and other objects, features, and advantages of the present invention will be made apparent from the following detailed description and from the drawings in which.

DETAILED DESCRIPTION OF THE PREFERRED EMBODIMENTS

Figure 1:
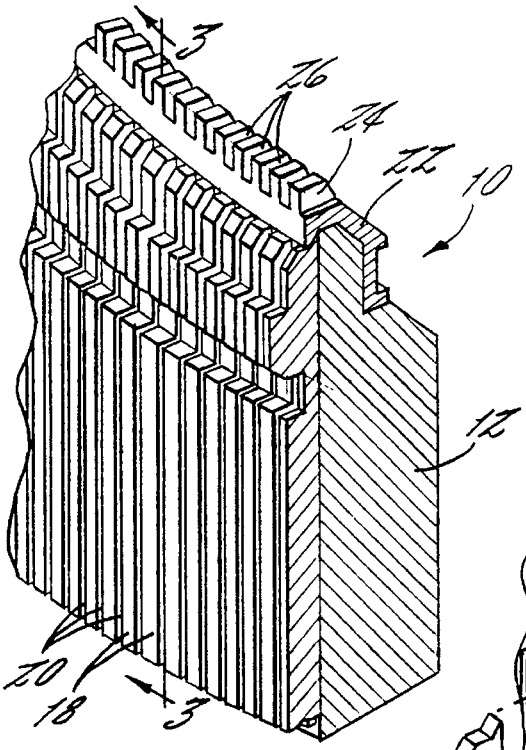
FIG. 1. PRIOR ART
FIG. 1 is sectional perspective view of a portion of one cylinder assembly known in the prior art, which includes a top ring and inserts attached thereto.
Figure 2:
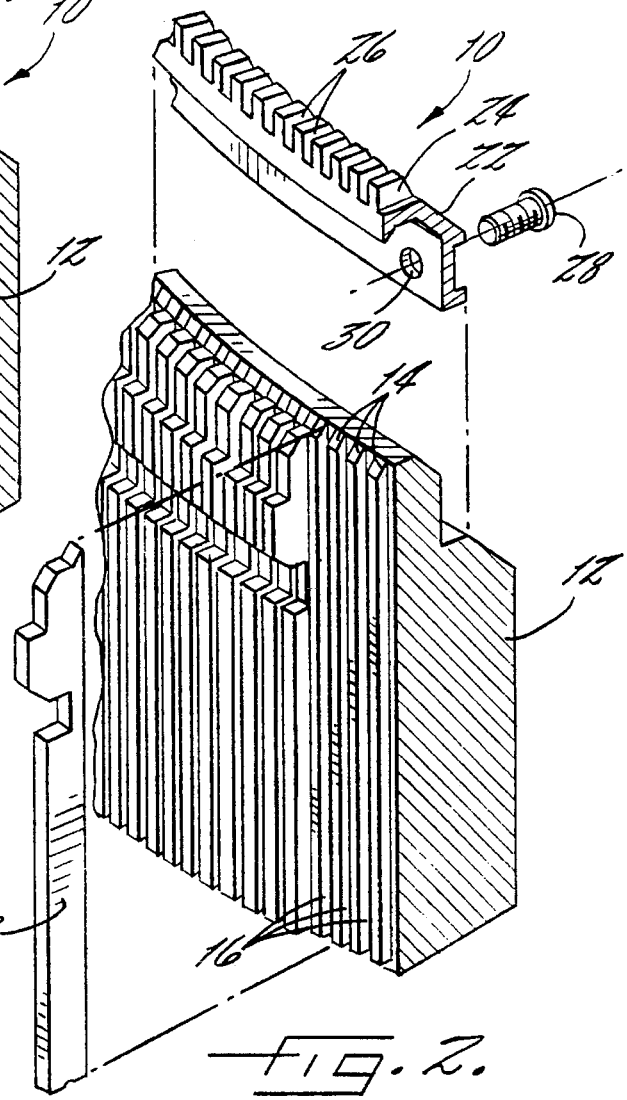
FIG. 2. PRIOR ART
FIG. 2 is an exploded view of the prior art cylinder body and top ring assembly shown in FIG. 1.
Figure 3:
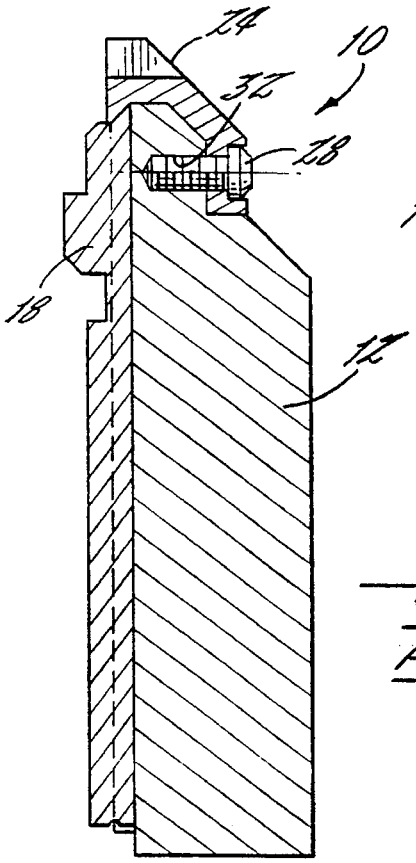
FIG. 3. PRIOR ART
FIG. 3 is a cross-sectional elevation view of the prior art cylinder assembly taken along line 3—3 of FIG. 1.
Figure 4:
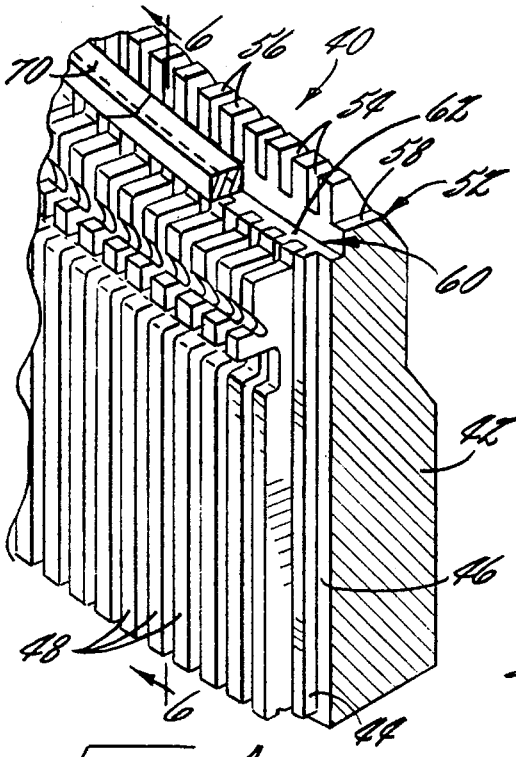
FIG. 4 is a sectional perspective view of a portion of a cylinder assembly having a hardened band according to the present invention.

FIGS. 4–7 illustrate a cylinder assembly according to the present invention, as shown generally at 40. A cylinder body 42 is preferably machined to have a plurality of spaced-apart, outwardly extending walls 44 on its outer cylindrical face, which define radial slots 46 between adjacent walls. An insert 48 is positioned within each of the slots 46, with each of the inserts extending outwardly beyond the walls 44 to define needle-receiving channels (i.e. tricks) 50 between adjacent inserts 48.

The cylinder body 42 also preferably includes an upper peripheral face, which is shown generally at 52. The upper face 52 desirably has a first substantially horizontal ledge 58, from which a plurality of spaced-apart, substantially radial channels 54 preferably extend upward in an upward direction. The channels 54 are preferably defined by a plurality of upwardly extending walls 56, with the channels being located between adjacent walls.

Figure 5:
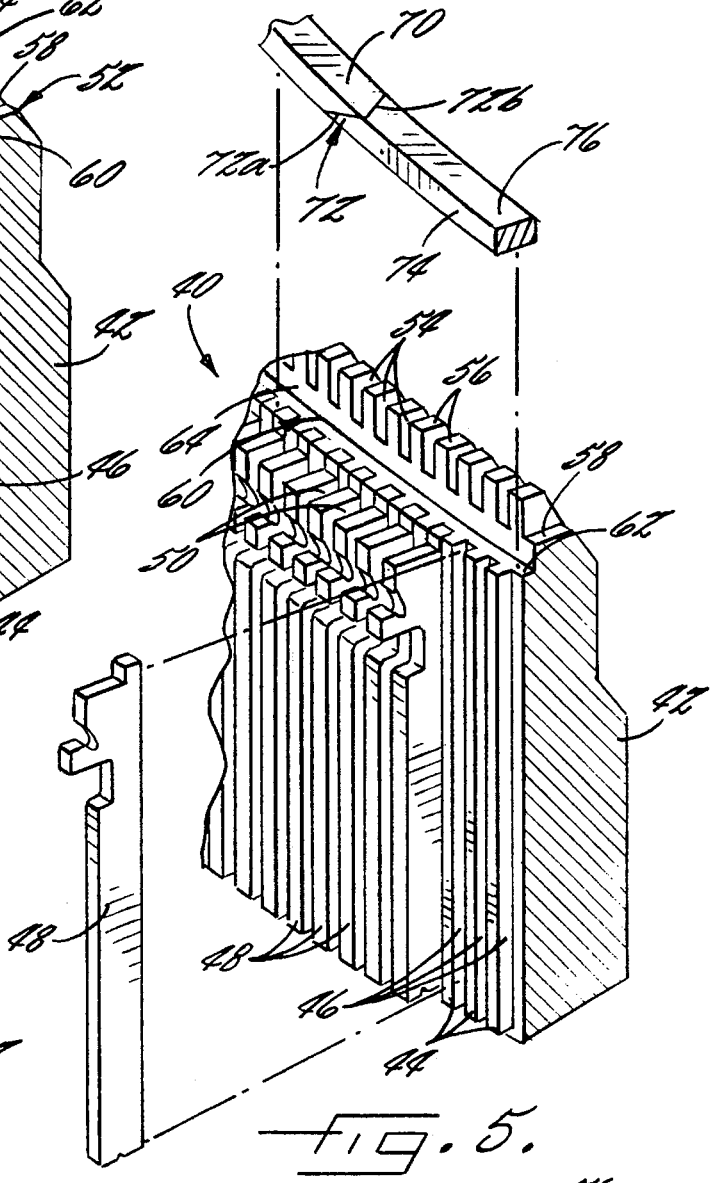
FIG. 5 is an exploded view of the cylinder body, hardened band and insert assembly according to the present invention.
Figure 7:
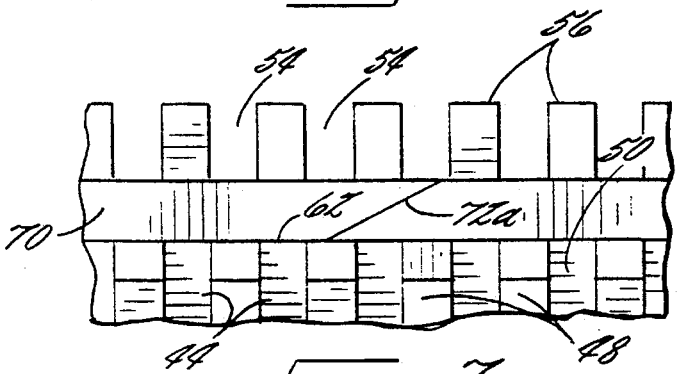
FIG. 7 is a radial elevation view of an upper region of the cylinder assembly according to the present invention in the direction of the arrows 7—7 in FIG. 6.

A shaped circumferential indentation, as shown generally at 60, is desirably formed to circumscribe an upper end of the outer cylindrical face, and desirably extends substantially below and outwardly from the first substantially horizontal ledge 58 of the upper face. In a preferred form of the invention, the shaped circumferential indentation 60 has a substantially right-angle configuration, forming a second horizontal ledge 62 at a position below and outwardly from the first horizontal ledge 58, and with the first and second horizontal ledges being connected by a vertically extending portion 64 of the cylinder body. In a particularly preferred form of the invention, each of the inserts 48 has a substantially straight upper face which terminates proximate the second horizontal ledge 62, as shown in FIG. 5. In this way, a smooth surface is maintained across the second horizontal ledge 62 when the inserts 48 are positioned within their respective slots 46. Further, this configuration enables the inserts 48 to flushly abut the hardened circular band, and thereby assist in its support, as discussed further below.

A hardened circular band 70 preferably matingly engages the shaped circumferential indentation 60, and is secured therein by way of conventional securing means such as adhesives, soldering, etc. The hardened circular band 70 preferably has a substantially constant cross-sectional configuration. In a preferred embodiment of the invention, the hardened circular band 70 has a substantially rectangular cross-sectional configuration; particularly preferred is a square cross-sectional configuration. When the hardened circular band 70 has a such a rectangular configuration, it is preferred that the indentation 60 circumscribing the upper end of the outer cylindrical face of the cylinder body 42 has a right-angle configuration, as this enables a secure and accurate engagement between the respective parts. It is noted, however, that other cross-sectional configurations for the hardened circular band could be used; for example, the band could have a portion of a rectangularly-shaped configuration, which is carved out to form a substantially "C" or bracket-shaped configuration. Further, selected ones of the inserts 48 could extend upwardly beyond the second horizontal ledge 62 and project into mating indentations (not shown) in the hardened circular band 70.

The hardened circular band 70 is desirably formed of metal which is heat treated prior to its engagement to the cylinder body 42, preferably until it has a hardness of between about 58 and 64 on the Rockwell C scale. It has been found that circular bands 70 having a hardness of at least about the high 50's and low 60's on the Rockwell C scale, and preferably between about 58 and 64, provide particularly good durability and wear characteristics to the cylinder. A particularly preferred hardness is in the range of 62 to 64 on the Rockwell C scale. However, the invention can be effectively practiced without limitation to these values.

Because materials which are heat treated to improve their hardness tend to become misshapen as a result of material expansion, contraction, and warping, it is preferred that the hardened circular band 70 of the present invention is provided with a discontinuous circumference. Particularly preferred is a discontinuous circumference which is defined by a single biased cut 72. In this way, if the band 70 becomes slightly deformed during the heat treating process, the single bias cut 72 can accommodate for the slight deformity when the band is engaged with the indentation 60 on the cylinder body 42, by allowing the respective ends of the band to move slightly relative to each other. Further, the biased cut assists in forming a friction fit of between the hardened circular band 70 and the cylinder body 42, due to compression of the band on the cylinder body. It is noted, however, that additional or supplemental means for securing the hardened circular band 70 to the cylinder body 42 can be utilized, such as adhesives, soldering, or the like.

A particularly preferred configuration for the biased cut is one which is biased in more than one direction along adjacent faces of the band, as shown at **72*a* and 72*b*. In this way, the cut extends diagonally along respective band faces, rather than horizontally and vertically as would be the case with a non-biased cut. As a result, should a gap be formed when the hardened circular band 70 is secured to the cylinder body 42**, the gap will extend diagonally with respect to the reciprocating elements of the knitting machine for which it forms a wear surface. Thus, a risk that the reciprocating elements, i.e. the sinkers and/or needles, will fall into the such a gap is effectively eliminated because the gap would not extend parallel to the element.

Figure 6:
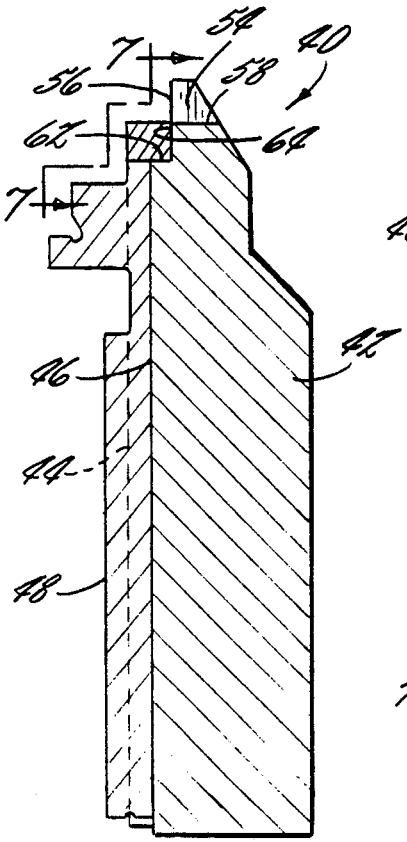
FIG. 6 is a cross-sectional elevation view of the cylinder assembly according to the present invention, taken along line 6—6 of FIG. 4.

When the hardened circular band 70 is secured to the cylinder body 42, as shown for example in FIG. 6, the band provides wear surfaces for the vertically reciprocating needles (not shown) located in the tricks 50. In addition, the band 70 can simultaneously provide a wear surface for the horizontally reciprocating knitting machine elements, such as the bottoms of the sinker pawls. It is noted also that the durable cylinder assembly of the present invention can be used in knitting machines which have both cylinder and dial needles, such as rib or interlock knitting machines. In the cylinder and dial knitting machine embodiments, the hardened circular band 70 can serve as a wear surface for the backs of the needles from each of the cylinder and dial.

In a particularly preferred form of the invention, an outer edge 74 of the hardened circular band 70 and outer edges of the walls 44 defining the radial slots 46 on the outer cylindrical face of the cylinder body 42 are substantially coplanar, so that a smooth needle-bearing surface is provided along the walls and the circular band. Similarly, the circular band desirably has an upper edge 76 which is substantially coplanar with said first horizontal ledge 58, so that a smooth bearing surface is provided for the horizontally reciprocating knitting elements, such as the sinkers or the dial needles.

Because of its simple assembly, the band 70 according to the present invention has a lesser tendency to deform during heat treatment than the prior art top rings, and its configuration, which does not require slotting, thus is easier to manufacture and reshape if necessary.

To produce a durable cylinder assembly according to the present invention, a hardened circular band is positioned on a cylinder body of a knitting machine such that a first surface of the band contacts the backs of the horizontally reciprocating machine elements, and a second surface of the band contacts the backs of the vertically reciprocating machine elements. The cylinder is preferably machined to have an outer circumferential face, and an indentation circumscribing an upper end of its outer cylindrical face. The hardened band is preferably heat treated for hardness, and has a discontinuous circumference which enables it to accommodate for slight deformations which may occur during the heat treatment process. The discontinuous circumference is preferably defined by a single biased cut in the band, which is preferably biased in more than one direction, i.e. doubly biased, so that any gap which may form along the cut when the band is engaged with the cylinder body does not extend parallel to the direction of movement of the reciprocating knitting machine elements. This band is then secured within the indentation, by frictional forces, adhesives or the like, to thus form durable wear surfaces for the reciprocating elements.

It is also contemplated that existing knitting machines in which the cylinder assemblies are worn could be reconditioned by modifying the cylinder body to form a circumferential indentation therein, then installing a hardened band within the indentation such that it provides durable wear surfaces for the reciprocating elements of the machine, i.e. the needles and/or sinkers.

In the drawings and specification, there have been disclosed typical preferred embodiments of the invention and, although specific terms are employed, these terms are used in a descriptive sense only and not for purposes of limitation. The invention has been described in considerable detail with specific reference to various illustrated embodiments. It will be apparent, however, that various modifications and changes can be made within the spirit and scope of the invention as described in the foregoing specification and defined in the appended claims.

That which is claimed is:

1. A cylinder assembly for a circular knitting machine, comprising:

a cylinder body having an outer cylindrical face and an upper face, said upper face including a plurality of spaced-apart, substantially radial channels and a shaped circumferential indentation circumscribing an upper end of said outer cylindrical face, and a hardened circular band matingly engaged with said circumferential indentation to define a durable bearing surface for reciprocating elements of the knitting machine.

2. The cylinder assembly according to claim 1, wherein said shaped circumferential indentation is in the form of a right angle, and said hardened circular band has a substantially rectangular cross-sectional configuration.

3. The cylinder assembly according to claim 2, wherein said hardened circular band has a substantially square cross-sectional configuration.

4. The cylinder assembly according to claim 1, wherein said hardened circular band has a discontinuous circumference.

5. The cylinder assembly according to claim 4, wherein said discontinuous circumference is defined by a single biased cut.

6. The cylinder assembly according to claim 5, wherein said single biased cut is biased in more than one direction.

7. The cylinder assembly according to claim 1, wherein said outer cylindrical face includes a plurality of spaced-apart, radial slots, and further comprising a plurality of inserts positioned within said slots to define a series of needle-receiving channels.

8. The cylinder assembly according to claim 7, wherein said radial slots are defined by a plurality of spaced-apart, outwardly extending walls, and wherein an outer edge of said hardened circular band and outer edges of said walls are substantially coplanar so as to provide a smooth needle-bearing surface along the walls and the circular band.

9. The cylinder assembly according to claim 7, wherein each of said inserts has a substantially planar upper edge which is adapted to flushly abut said hardened circular band, in order that said inserts assist in supporting said band in mating engagement with said circumferential indentation.

10. The cylinder assembly according to claim 1, wherein lower ends of said substantially radial channels and an upper edge of said circular band are substantially coplanar so as to provide a smooth bearing surface across the circular band and within the channels.

11. The cylinder assembly according to claim 1, wherein said hardened circular band comprises heat treated metal.

12. The cylinder assembly according to claim 1, wherein said hardened circular band has a hardness of between about 58 and 64 on the Rockwell C scale.

13. The cylinder assembly according to claim 1, wherein said spaced-apart, substantially radial channels in said upper face define sinker receiving channels.

14. A circular knitting machine comprising a cylinder body having a first horizontal ledge extending circumferentially about an upper portion of the cylinder body, said ledge having a plurality of spaced-apart walls extending upwardly therefrom to define a plurality of radial slots, and a second horizontal ledge extending circumferentially about an upper portion of the cylinder body at a position below and outwardly from said first horizontal ledge, said first and second horizontal ledges being connected by a vertically extending portion of said cylinder body, said vertically extending portion and said second horizontal ledge defining an indentation in the cylinder body in the shape of a right angle, and a circular band of hardened material matingly engaging said indentation, to thereby form a durable bearing surface on said cylinder body.

15. The circular knitting machine according to claim 14, wherein said circular band has a substantially rectangular cross-sectional configuration.

16. The circular knitting machine according to claim 14, wherein said circular band terminates proximate said first horizontal ledge, to thereby form a smooth continuous surface across said first horizontal ledge and said circular band.

17. The circular knitting machine according to claim 14, wherein said circular band has a discontinuous circumference.

18. The circular knitting machine according to claim 17, wherein said discontinuous circumference is defined by a single bias cut.

19. The circular knitting machine according to claim 14, wherein said cylinder body has an outer cylindrical face which includes a plurality of spaced-apart, outwardly extending walls defining a plurality of spaced-apart, radial slots, and wherein an outer edge of said hardened circular band and outer edges of said walls are substantially coplanar, to thereby provide a smooth bearing surface along the walls and the circular band.

20. The circular knitting machine according to claim 19, further comprising a plurality of inserts positioned within said radial slots and extending outwardly therefrom to define a series of needle-receiving channels extending outwardly from said walls, and wherein each of said inserts has a substantially planar upper edge which is adapted to flushly abut said hardened circular band, in order that said inserts can assist in supporting said band in mating engagement with said indentation.

21. A durable circular knitting machine assembly comprising:

a cylinder body having an outer cylindrical face and an upper face, said upper face including a plurality of spaced-apart, substantially radial channels and said outer cylindrical face including a plurality of spaced-apart radial slots and a plurality of inserts positioned within said slots to define a series of needle-receiving channels, a plurality of needles positioned within said needle-receiving channels for vertically reciprocating movement therein, a plurality of sinkers positioned for horizontal reciprocating movement within said plurality of spaced-apart, substantially radial channels, and a hardened circular band extending circumferentially about an upper end of said cylinder body and positioned to abut backs of said needles and pawls of said sinkers, to thereby form durable wear surfaces therefor.

22. The knitting machine according to claim 21, wherein said hardened circular band has a discontinuous circumference defined by a single biased cut.

23. The knitting machine according to claim 22, wherein said single biased cut is biased in more than one direction.

24. The knitting machine according to claim 21, wherein said hardened circular band is matingly engaged in a circumferential indentation circumscribing an upper end of said outer cylindrical face.

25. A method of improving the durability and lifespan of the cylinder of a circular knitting machine having both cylinder and dial needles comprising the step of positioning a circular band of hardened material having a substantially rectangular cross-sectional configuration and a discontinuous circumference on a cylinder body of a knitting machine such that a first surface of the band contacts horizontally reciprocating elements of the knitting machine and a second surface of the band contacts vertically reciprocating elements of the knitting machine, to thereby provide durable wear surfaces on the cylinder body for the horizontally and vertically reciprocating elements.

26. The method according to claim 25, wherein the circular band has a discontinuous circumference defined by a single biased cut.

27. The method according to claim 26, wherein said single biased cut is biased in more than one direction.

28. The method according to claim 25, wherein the circular band comprises heat treated metal.

29. The method according to claim 25, wherein the horizontally reciprocating elements comprise sinkers.

30. The method according to claim 25, wherein the horizontally reciprocating elements comprise needles.

31. A method of making a durable cylinder for a circular knitting machine comprising the steps of forming a cylinder body having an outer cylindrical surface and an upper peripheral face and including a plurality of spaced-apart, radial channels extending outwardly from the upper peripheral face and a right angle indentation circumscribing said outer cylindrical surface, and positioning a circular band of hardened material within the right angle indentation, to thereby provide wear surfaces for the reciprocating elements of a knitting machine about the cylinder body.

32. The method according to claim 31, wherein the circular band has a discontinuous circumference.

33. The method according to claim 31, wherein the reciprocating elements comprise needles.

34. The method according to claim 33, wherein the reciprocating elements further comprise sinkers.

35. A method of enhancing the durability of a circular knitting machine comprising the step of providing a circular band of hardened material having a discontinuous circumference as a result of a single biased cut extending diagonally through the cross-sectional diameter of the band on a cylinder body of a circular knitting machine such that the band is located proximate needle and sinker contacting portions of the cylinder body, to thereby provide durable wear surfaces thereto.

* * * * *